United States Patent [19]

Newsome

[11] Patent Number: 4,686,807

[45] Date of Patent: Aug. 18, 1987

[54] STRUCTURALLY REINFORCED, PRE-FABRICATED AND MODULAR CHIMNEY FACADE SYSTEM

[76] Inventor: R. Wayne Newsome, P.O. Box 39, Columbia, Md. 21045

[21] Appl. No.: 868,090

[22] Filed: May 29, 1986

Related U.S. Application Data

[63] Continuation-in-part of Ser. No. 666,761, Oct. 31, 1984, Pat. No. 4,593,510.

[51] Int. Cl.[4] ..... E04C 1/00

[52] U.S. Cl. ..... 52/314; 126/307 R; 126/120; 110/184

[58] Field of Search ..... 52/218, 219, 314, 235; 126/307 R, 120; 110/184

[56] References Cited

U.S. PATENT DOCUMENTS

| | | | |
|---|---|---|---|
| 1,796,048 | 3/1931 | Robinson | 52/89 |
| 2,043,697 | 6/1936 | Deichmann | 52/235 |
| 2,116,118 | 5/1938 | Leash | 126/307 R |
| 4,593,510 | 6/1986 | Newsome | 52/314 |

*Primary Examiner*—James L. Ridgill, Jr.
*Attorney, Agent, or Firm*—Morton J. Rosenberg

[57] ABSTRACT

A structurally reinforced, pre-fabricated and modular chimney facade system (10) is provided for enclosing a chimney stack (12) passing therethrough. The chimney facade system (10) is adapted to be secured to an external wall (16) of a building structure (14). The chimney facade system (10) includes a first one-piece base housing (22) and at least a second one-piece base housing (24) adapted to be mounted to base foundation housing (26). Facade system (10) includes a structural support mechanism (36) for at least the first and second one-piece base housings (22 and 24) for coupling each to the other and for coupling the combination to the building structure (14). The structural support mechanism (36) includes a mechanism for adjustably applying a force loading between the external wall (16) of the building structure (14) at least the combination of the first and second one-piece base housings (22 and 24). The first and second one-piece base housings (22 and 24) as well as additional housings (112, 120, 122 and 124 ) are formed in one-piece formation and generally molded of a plastic composition. In this manner, there is provided a structurally reinforced, lightweight, and easily assembled chimney facade system (10).

31 Claims, 9 Drawing Figures

124
130
10
132
128
54
46
38
64
32
98
5
46
90
44
30
5
98
4
122
34
36
4
54
24
38
70
42
120
20
44
34
12
38
68
6
114
126
28
70
70
118
22
38
6
100
32
34
42
32
112
102
116
102
104
26
16
106
108

STRUCTURALLY REINFORCED, PRE-FABRICATED AND MODULAR CHIMNEY FACADE SYSTEM

RELATED U.S. PATENT APPLICATION

This patent application is a Continuation-in-Part of U.S. patent application Ser. No. 666,761, filed on Oct. 31, 1984, now U.S. Pat. No. 4,593,510, issued June 10, 1986.

BACKGROUND OF THE INVENTION

1. Field of the Invention

This invention pertains to structurally reinforced, pre-fabricated and modular chimney facade systems. In particular, this invention directs itself to a pre-fabricated and modular chimney facade system which may be assembled on-site of a construction project. Further, this invention directs itself to a chimney facade system which includes a multiplicity of one-piece base housing units defining a through passage within which a chimney stack is located. Still further, this invention relates to a chimney facade system which allows for individual coupling of discrete housing units in varying combinations to provide a pre-fabricated/modular type chimney facade structure adaptable to a plurality of building contours.

Further, this invention directs itself to a chimney facade system wherein the modular base housings are coupled each to the other and structurally reinforced for coupling to an external building structure.

Prior Art

Chimney facade systems are well-known in the art. However, pre-fabricated and modular chimney facade systems of the type herein described have not been seen in the prior art. The best prior art known to the Applicant includes U.S. Pat. Nos. 3,538,656; 2,539,177; 3,425,178; 3,464,174; 3,466,000; 4,384,566; 3,460,525; 3,761,551; 3,874,364; 2,687,127; 4,259,941; 797,856; 3,278,742; 3,089,521; 252,064; 4,180,052; and 3,809,051.

None of the prior art systems known to Applicant provide for the structural reinforcement mechanism for a modular housing facade system as is described in the instant invention concept. In general, prior art systems direct themselves to non-modular concepts utilizing structural elements which do not necessitate the need for structural reinforcement, as is herein provided.

Some prior art systems are directed to pre-fabricated sectional element systems for chimneys as is shown in U.S. Pat. No. 3,538,656. Such chimney system stacks consist of a multiplicity of one story high prefabricated sectional elements. However, such sectional elements provide for an outer jacket formed of a concrete composition with a reinforcing steel mat. Such prior art systems are formed of relatively heavy type material compositions and do not provide for a plastic material composition to provide weight saving and cost effectiveness.

In other prior art systems such as that shown in U.S. Pat. No. 4,180,052, there are provided furnace fireplace systems which include an outer shell having a metal cabinet covering an inner cabinet. Such prior art systems are generally directed to internally mounted fireplace apparatus, which extend above the fireplace and pass through a ceiling through a roof. Such systems are not directed to housings which are adapted to be mounted external to a building structure. As is seen in such prior art systems, the panels are generally secured together by welding techniques, and such certainly are not directed to pre-fabricated and modular chimney facade systems as is necessary to the subject invention concept. Such prior art systems thus do not necessitate the use of a structurally reinforcing mechanism as is clearly shown in the invention concept of this disclosure. In still other prior art systems, such as that shown in U.S. Pat. No. 252,064, there are provided heating apparatus which may show flange sections, however, such systems do not provide for coupling of one-piece housings in a modular fashion as is necessitated by the invention concept herein described. Such do not direct themselves to the coupling to base house foundations and are not adaptable to coupling to external walls of building structures utilizing the particular compositions as herein disclosed.

In still further prior art systems, such as that shown in U.S. Pat. No. 2,539,177, there are provided pre-fabricated block flues having a multiplicity of blocks being provided depending upon the height of the overall building structure. However, such blocks are generally formed of a refractory or fireproof material such as cement or firebrick clay. Such prior art systems do not provide for material compositions which allows for ease of varying the height and dimensions of the particular system on-site.

In general, prior art systems do not allow for one-piece housings carried and mounted by a single person in a simplified fashion. Such prior art systems generally necessitate increased manufacturing, as well as labor costs in construction.

SUMMARY OF THE INVENTION

A structurally reinforced, pre-fabricated and modular chimney facade system for enclosing a chimney stack passing therethrough. The chimney facade system is adapted to be fixedly secured to an external wall of a building structure. The chimney facade system includes a first one-piece base housing which is fixedly secured to a base foundation housing positionally located external and adjacent the building structure, and an external surface of the external wall. The first one-piece base housing defines a first through passage having a cross-sectional area greater than a cross-sectional area of the chimney stack. Additionally, there is included at least a second one-piece base housing which is removably mountable and fixedly securable to the first one-piece base housing and the external wall of the building structure. The second one-piece base housing defines a second through passage having a cross-sectional area substantially equal to the cross-sectional area of the first through passage of the first one-piece base housing at an interface of the first and second one-piece base housings. Further, there is included a mechanism for structurally supporting and reinforcing the first and second one-piece base housings to the external wall of the building structure.

DESCRIPTION OF THE PREFERRED EMBODIMENTS

Figure 1:
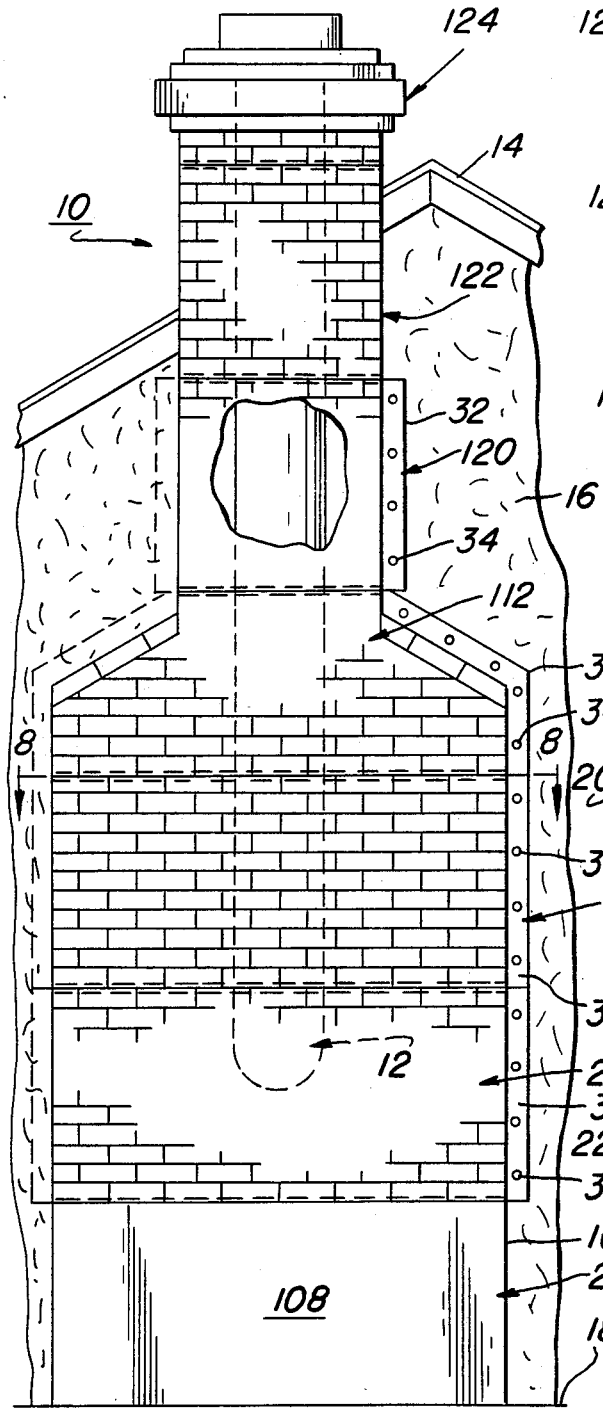
FIG. 1 is an elevational view partially cut-away of the subject chimney facade system.
Figure 2:
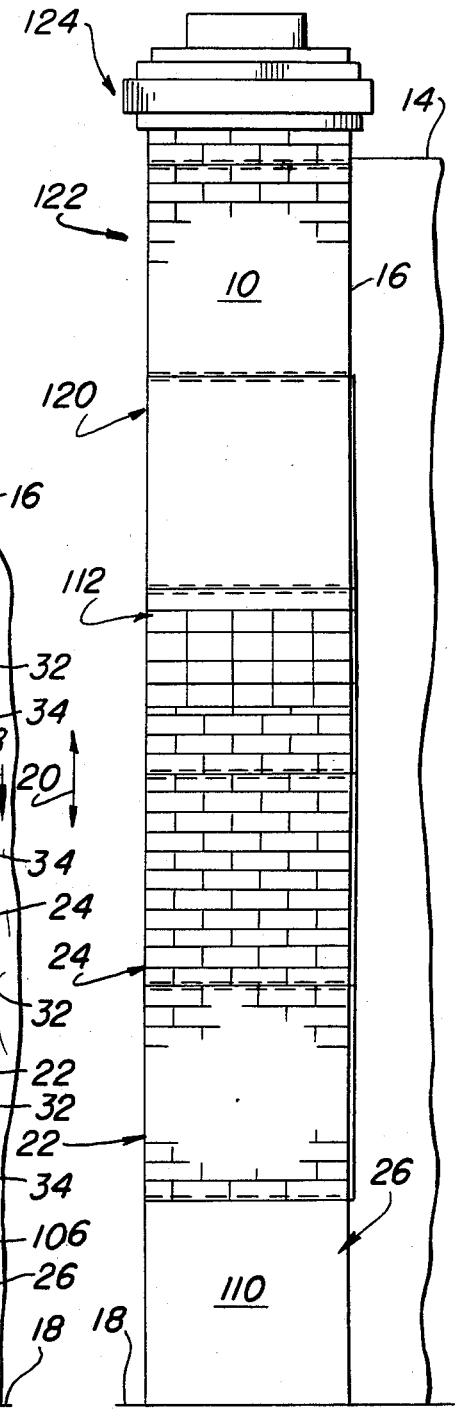
FIG. 2 is a side elevational view of the subject chimney facade system.

Referring now to FIGS. 1-9, there is shown structurally reinforced, pre-fabricated and modular chimney facade system 10 for enclosing chimney stack 12 passing therethrough. Structurally supported and reinforced pre-fabricated and modular chimney facade system 10 is fixedly secured to external wall 16 of building structure 14 as is shown in FIGS. 1 and 2. Further, chimney facade system 10 is adapted to be mounted in overall construction on base surface or ground 18 adjacent building structure 14. In overall concept, chimney facade system 10 may be used to provide a pleasing aesthetic representation of a brick fireplace when viewed external to building structure 14. Generally, chimney facade system 10 may be utilized in connection with an internal fireplace or other heating mechanism used in commercial and/or domestic environments.

Chimney facade system 10 is an improvement in an overall facade system described in U.S. patent application Ser. No. 666,761 filed on Oct. 31, 1984, entitled "Pre-Fabricated and Modular Chimney Facade System", now U.S. Pat. No. 4,593,510, issued June 10, 1986.

In various prior art systems, chimney facade systems have been utilized and formed out of varying structural materials, such as brick, wood, and other like construction compositions. As will be seen, chimney facade system 10 of the subject invention concept provides for a modular system which is pre-fabricated off-site. Additionally, the lightweight characteristics of the particular facade system composition allows for on-site placement by one person.

Additionally, since facade system 10 is formed by a relatively small number of sectional housings, the volume is minimized for shipping and provides for easy transportability to the site of the construction. Once at the construction site, entire sections may be carried by a single person and installed in a minimal amount of time to decrease the labor costs. Still further, since the housing sections of facade system 10 are formed by general molding techniques to provide a small number of overall construction pieces, the cost of materials is further minimized.

In prior art U.S. patent application Ser. No. 666,761, now U.S. Pat. No. 4,593,510, issued June 10, 1986, such systems have successfully tested under varying environmental conditions. However, under extreme environmental conditions, due to the lightweight nature of the materials, such may be affected by wind/temperature variations over extended periods of time. In order to provide a system which would have the capability of extended and continuous use over long periods of time, structurally supported and reinforced pre-fabricated and modular chimney facade system 10 of the subject invention concept as will be described in following paragraphs, has been instituted.

Chimney facade system 10 as shown in the accompanying Figures, is composed of a plurality of one-piece formed housings. Facade system 10 extends generally in vertical direction 20 as is shown in FIGS. 1 and 2 and is easily mountable to building structure 14 and external wall 16 in an easily shown manner, as was detailed in U.S. patent application Ser. No. 666,761 of which this invention concept is a Continuation-in-Part.

Chimney stack 12 may be formed of conventional stainless steel metallic composition, or some like material, and is surrounded by an insulating air space as is shown in FIG. 1. Air is a high thermal insulator and temperatures on the internal surfaces of facade system 10 have been found to be minimal in nature and well within any temperature criteria for such systems. Temperatures have been found to rise only a few degrees on the exterior surfaces of facade system 10 even when a fireplace is being utilized with the extremely high temperatures found on the exterior surfaces of chimney stacks 12.

Figure 3:
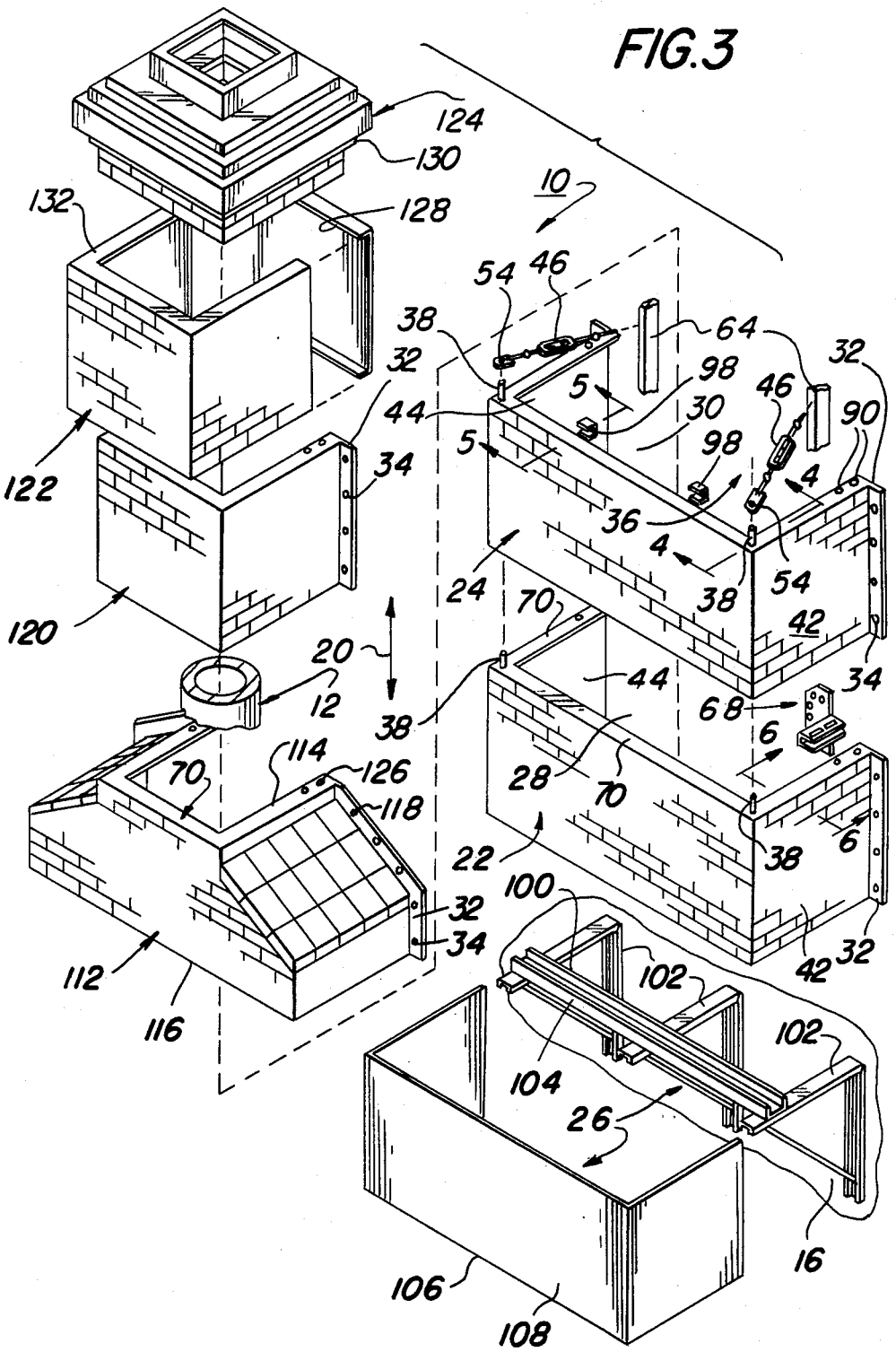
FIG. 3 is a perspective, exploded, partially cut-away view of the subject chimney facade system.

As is seen in FIGS. 1-3, structurally supported prefabricated and modular chimney facade system 10 is formed of a multiplicity of modular housing members which may be stacked in substantially vertical direction 20 to provide the overall structure of facade system 10. It is to be clearly understood that following paragraphs will describe various housing sections which may be inserted into the overall structure in varying manners and configurations, some of the housings possibly removable from certain configurations and additional housings added to other types of configurations responsive to the desires of the user and the particular configuration of building structure 14 which is not part of the inventive concept of this invention system.

Referring now to FIGS. 1-3, it is seen that facade system 10 includes first one-piece base housing 22 fixedly secured to base foundation housing 26, to be described in following paragraphs, wherein first one-piece base housing 22 is positionally located external and adjacent building structure 14 and an external surface of external wall 16 of building structure 14. First one-piece base housing 22 defines first through passage 28 having a cross-sectional area greater than a cross-sectional area of chimney stack 12.

Further, facade system 10 includes second one-piece base housing 24 which is removably mountable and fixedly securable to first one-piece base housing 22 and external wall 16 of building structure 14. Second one-piece base housing 24 defines second through opening 30 having a cross-sectional area substantially equal to the cross-sectional area of first through passage 28 of first one-piece base housing 22 at an interface of first and second one-piece base housings 22, 24.

As is shown in FIGS. 1 and 3, as was described in U.S. patent application Ser. No. 666,761, the housings of the subject invention concept include a mechanism for coupling the housings to external wall 16 of building structure 14. As is seen for first and second one-piece base housings 22 and 24, there is provided housing flange members 32 generally extending in vertical direction 20 through the vertical height of each of the housing sections. Housing flange members 32 extend laterally and external to first and second one-piece base housings 22 and 24 as is seen in FIGS. 1 and 3 for interfacing with external wall 16 of building structure 14. Housing flange members 32 may include vertically displaced openings 34 through which nails, bolts, or some like mechanism may be inserted to mount housing sections such as first and second one-piece base housing 22 and 24 to external wall 16. In this way, the housing sections may be fixedly secured to external wall 16.

Of extreme importance of the inventive concept of facade system 10 is the fact that housing sections such as first one-piece base housing and second one-piece base housing 22 and 24 are molded in one-piece formation. Thus, base housings 22 and 24 may be formed of a plastic closed-cell composition well-known in the art. Housing flange members 32 are also formed generally of the same plastic composition and are formed in one-piece formation with the housing sections, such as base housings 22 and 24.

In constructive operation, the housing sections may be transported to the construction site and installed on previously formed base foundation housings 26 to be described in following paragraphs or on concrete foundations well-known in the art.

Figure 4:
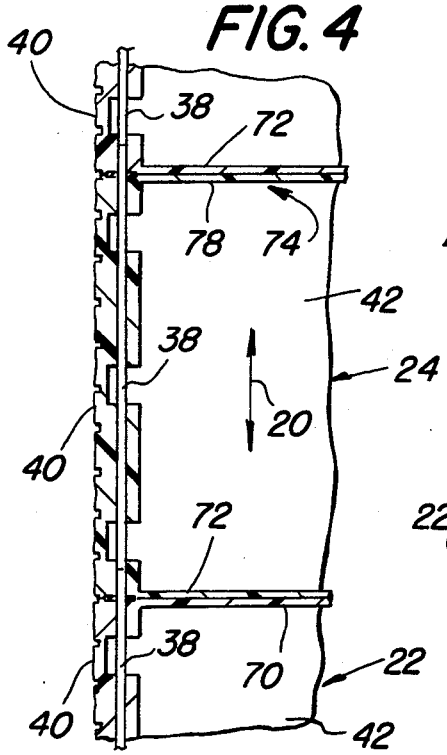
FIG. 4 is a sectional view of the chimney facade system taken along the Section Line 4—4 of FIG. 3.
Figure 8:
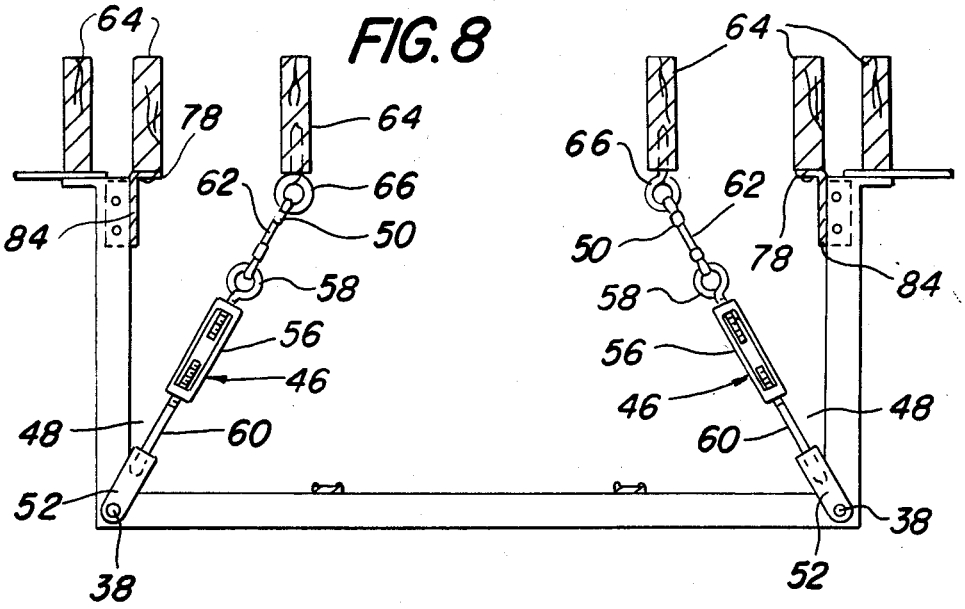
FIG. 8 is a planar view of a portion of the base housing of the subject chimney facade system showing the support mechanism; and, FIG. 9 is an exploded perspective view partially cut-away showing a pair of one-piece base housings of the subject facade system.

Facade system 10 includes a mechanism for structurally supporting the housing sections and importantly, first and second one-piece base housings 22 and 24 to external wall 16 of building structure 14. Structural support mechanism 36 includes a mechanism for adjustably applying a force loading between external wall 16 of building structure 14 and at least one of first and second one-piece base housings 22 and 24. Referring to FIGS. 3, 4 and 8, it is seen that structural support mechanism 36 includes rod members 38 extending in substantially vertical direction 20 within a wall member of at least one of base housings 22 and 24 and extending above an upper surface thereof for interfitting with a next vertically mounted base housing.

As can be seen in the Figures, first and second one-piece base housings 22 and 24 (as well as other housing sections) are generally formed of frontal wall members 40 and laterally displaced opposing sidewall members 42 and 44. Each of base housings 22 and 24 may have a pair of rod members 38 extending through an intersection of frontal wall members 40 and opposing laterally displaced sidewall members 42 and 44, as is shown. Rod members 38 may be molded directly into the structure of base housings 22 and 24, or alternatively, may be passed through the wall members within the wall thickness and secured thereto through adhesive bonding, or some like technique, not important to the inventive concept of the subject invention.

Structural support mechanism 36 further includes a mechanism for securing rod members 38 to external wall 16 of building structure 14, as is more clearly shown in FIGS. 3 and 8. Securement mechanism 46 may be a turnbuckle mechanism coupled on first end 48 to a respective rod member 38 and on a second end 50 to external wall 16 of building structure 14. Each turnbuckle or securement mechanism 46 includes turnbuckle lug member 52 secured to turnbuckle first end 48 with turnbuckle lug member 52 having through opening 54 for insert and passage therethrough of a respective rod member 38. As can be seen, turnbuckle or securement mechanism 46 includes turnbuckle center threaded member 56 which threadedly engages left-hand screw member 58 and right-hand screw member 60. Right-hand screw member 60 is fixedly secured to turnbuckle lug member 52 and as will be seen, left-hand screw member 58 is coupled to external wall 16 of building structure 14. Thus, by rotation of turnbuckle center threaded member 56, respective tensioning or loosening of tensile force may be accomplished in a singular action and allows adjustability of the tension force associated with the force being applied to rod members 38 passing through various housing sections, such as first and second one-piece base housings 22 and 24.

Each of right-hand screw members 60 are coupled to turnbuckle lug members 52 through threaded securement, adhesive bonding, or some like mechanism not important to the inventive concept as herein described, with the exception that fixed securement be provided therebetween. Additionally, left-hand screw members 58 are ultimately coupled to external wall 16 on turnbuckle second ends 50 through link members 62 which may be coupled directly to external wall 16 or as is shown in FIG. 8, are coupled to stud members 64 which are mounted and fixed to external wall 16. Stud members 64 may be fixedly secured to external wall 16 through bolting, nailing, or some like mechanism well-known in the art. Where stud members 64 are utilized, link members 62 may be coupled thereto by threaded ring screws 66 as is shown in FIG. 8.

Referring now in particular to FIGS. 3, 6, 7, and 9, there is shown coupling mechanism 68 for coupling first and second one-piece base housings 22 and 24 each to the other and in combination securement to external wall 16 of building structure 14. First and second one-piece base housings 22 and 24 (as well as other housing sections) each include frontal wall members 40 and opposing laterally displaced sidewall members 42 and 44 as has been previously described. First one-piece base housing 22 includes first base housing flange member 70 at an upper section thereof extending internal through passage 28 and second one-piece base housing 24 includes second base housing flange member 72 at a lower section thereof extending internal second through passage 30 for mating interface with first base housing member 22 with the first and second base housing flange members 70 and 72 being captured within coupling mechanism 68.

Figure 5:
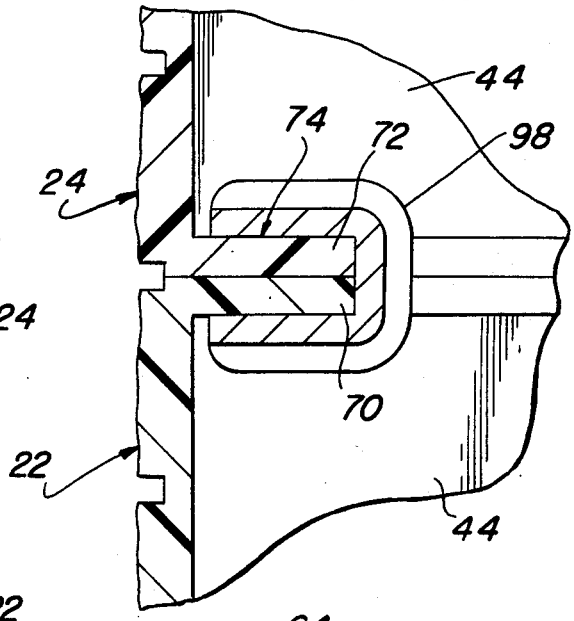
FIG. 5 is a partially cut-away sectional view of a clamping mechanism of the subject chimney facade system taken along the Section Line 5—5 of FIG. 3.

First and second housing flange members 70 and 72 are generally planar and extend substantially normal frontal wall members 40 and laterally displaced sidewall members 42 and 44 where the combination of first and second base housing flange members 70 and 72 when in mating engagement form internal ledge 74 as may be seen clearly in FIGS. 4 and 5. It is to be understood that first and second base housing flange members 70 and 72 are formed in one-piece formation through molding techniques with the remaining portions of respective one-piece base housings 22 and 24 as well as other base housing members.

Figure 9:
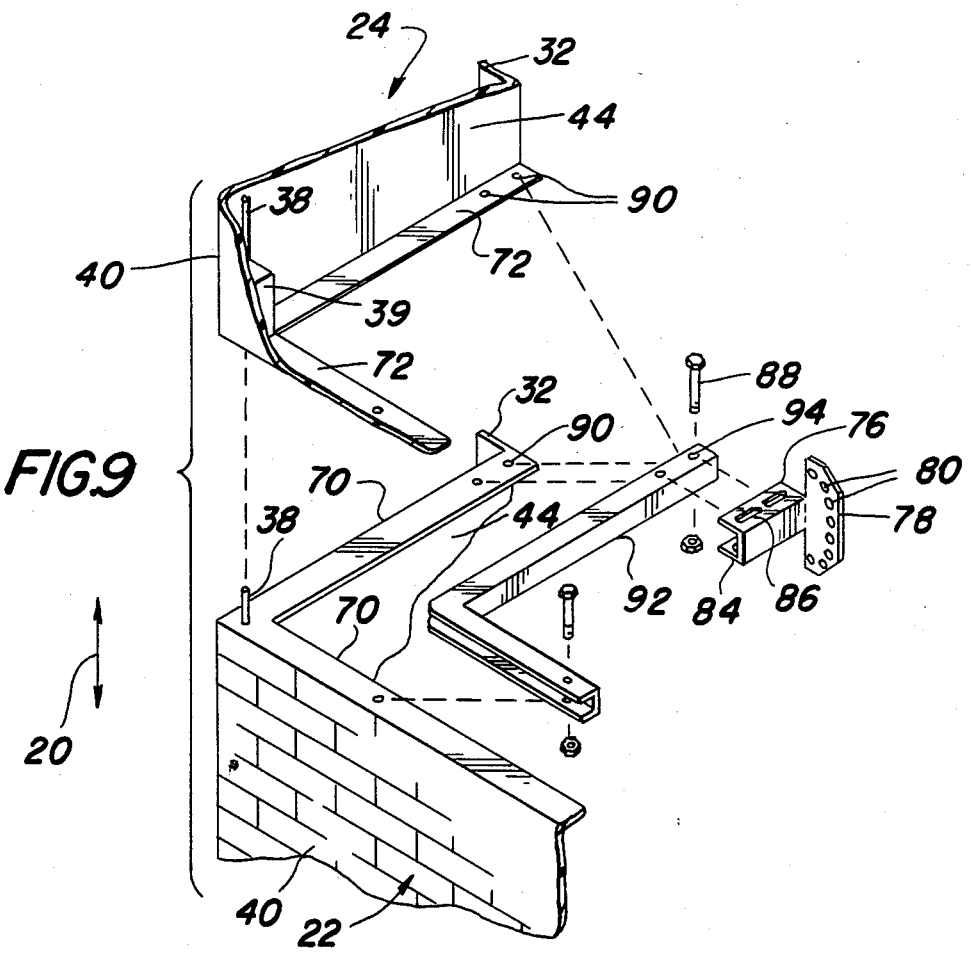

As can be seen in FIG. 9, block member 39 may be formed at corner sections of first and second one-piece base housings 22 and 24. Rod members 38 may pass partially therethrough to aid in structural integrity of facade system 10. Block members 39 may be formed in one-piece formation with housings 22 or 24 or may be coupled thereto in fixed coupling to a respective base housing flange member such as second base housing flange member 72 as shown in FIG. 9.

Figure 7:
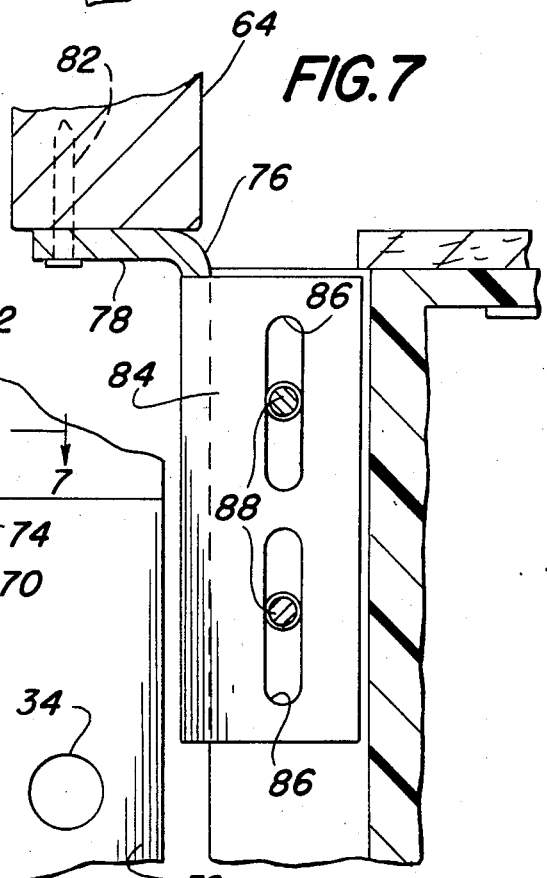
FIG. 7 is a sectional view of the reinforcing mechanism partially cut-away, taken along the Section Line 7—7 of FIG. 6.
Figure 6:
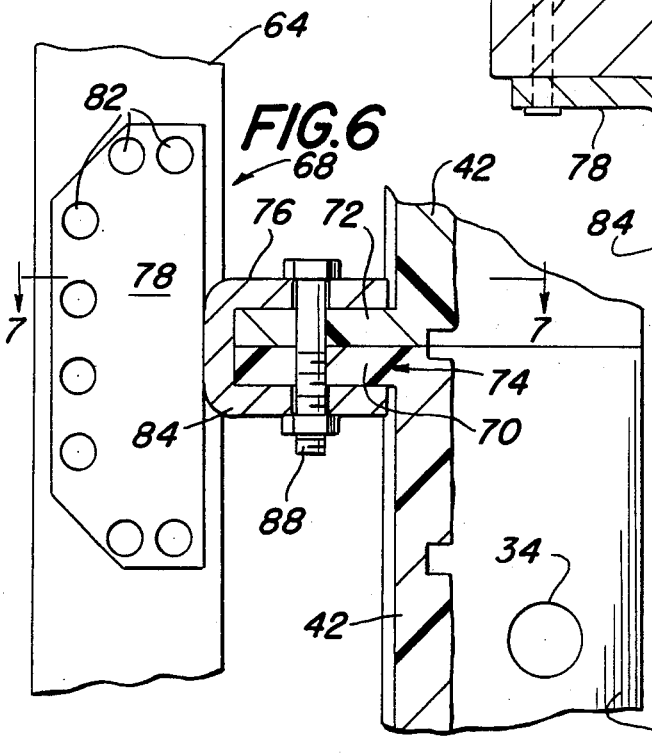
FIG. 6 is a sectional view partially cut-away of the reinforcing mechanism taken along the Section Line 6—6 of FIG. 3.

Referring more particularly to FIGS. 6, 7 and 9, coupling mechanism 68 includes mounting bracket 76 which includes substantially planar coupling plate member 78 fixedly secured to external wall 16 of building structure 14. Coupling plate member 78 includes a plurality of coupling plate openings 80 seen in FIG. 9 through which nails or bolts 82 may be mounted to external wall 16 or in the alternative, to stud members 64 as is seen in FIGS. 6 and 7.

Coupling mechanism 68 further includes U-shaped coupling plate member 84 which is secured to planar coupling plate member 78 and extends substantially normal therefrom. As can be seen, internal ledge 74 is captured within U-shaped coupling plate member 84 in fixed securement thereto. Upper and lower arm sections of U-shaped coupling plate member 84 include elongated slots 86 through which bolts 88 pass. Bolts 88 thus pass through U-shaped coupling plate member 84 and through corresponding and aligned openings 90 formed through internal flange members 72 and 70, as is clearly seen in FIGS. 6 and 9. Elongated slots 86 allow for minor dimensional adjustments of coupling mechanism 68 in relation to one-piece base housings 22 and 24.

Coupling plate member 78 and U-shaped coupling plate member 84 may be formed in one-piece formation and formed from a steel composition, or some like metallic composition to allow rigidity and coupling fixed mounting to external wall 16 or in the alternative, to stud members 64 which are then fixedly secured to external wall 16.

Referring now to FIG. 9, there is shown a further reinforcement technique which includes L-shaped reinforcement member 92 having an overall U-shaped contour for insert therein of internal ledge 74 when flange members 72 and 70 are matingly engaged in vertical alignment. L-shaped reinforcement member 92 extends throughout at least a portion of internal ledge 74 along at least a portion of sidewalls 44 as well as 42 and frontal walls 40 of first and second one-piece base housings 22 and 24. In this concept, U-shaped coupling plate member 84 would then have sandwiched therebetween L-shaped reinforcement member 92, as well as internal ledge 74. In this manner, the legs or opposing side-walls of U-shaped coupling plate member 84 would have a displaced distance corresponding to the entire sandwiched section being inserted therein. Further, bolts 88 would thus pass through elongated slots 86, openings 94 formed in L-shaped reinforcement members 92, and then corresponding openings 90 formed through flange members 72 and 70 as is clearly seen in FIG. 9.

As shown in FIGS. 3 and 5, a further coupling of internal flanges 70 and 72 may be accomplished through use of clamp member 98. Clamp member 98 is generally U-shaped in contour and may be inserted around internal ledge 74 comprising the mating flange members 70 and 72. Clamp member 96 may be adhesively secured through a bonding layer 98 or alternatively, may be structurally clamped by bending opposing U-shaped arm members into structural engagement. The manner and mode of coupling clamp members 96 to internal ledge 74 is not important to the inventive concept as herein described, with the exception that such provide additional securement of flange members 70 and 72 each to the other at specified internal locations of first and second one-piece base housings 22 and 24, as well as other base housing sections.

Chimney facade system 10 further may include base foundation housing 26 which interfaces with base surface or ground 18. Referring to FIGS. 1, 2 and 3, it is seen that base foundation housing 26 includes base foundation framework 100 secured to external wall 16 of building structure 14. Base foundation framework 100 includes a plurality of laterally displaced L-shaped framework members 102 which are coupled together through laterally extending channel member 104 to provide an open gridwork for mounting of first one-piece base housing 22 thereon. Securement of L-shaped framework members 102 to laterally extending channel member 104 may be through welding, bolting, or some like technique. Additionally, L-shaped framework members 102 may be secured to external wall 16 through bolting, or some other fixed securement method. Base foundation housing 26 further includes base wall structure 106 which is generally U-shaped in contour for interfacing and being coupled to lower portion of first one-piece base housing 22 and base foundation framework 100. Base wall structure 106 includes frontal wall member 108 and opposing laterally displaced sidewall members 110. Base wall structure 106 may be formed of a metallic composition, plastic composition, or some like composition not important to the inventive concept as herein described.

Structurally supported, pre-fabricated, and modular facade system 10 further may include third one-piece base housing 112, clearly shown in FIGS. 1 and 3. Third one-piece base housing 112 is fixedly secured in vertically aligned relation with either first or second one-piece base housings 22 or 24. Third one-piece base housing 112 is removably mounted and fixedly securable to first or second one-piece base housings 22 and 24 in a manner similar to that shown in U.S. patent application Ser. No. 666,761, as previously referenced.

Third one-piece base housing 112 defines transition through passage 114 of diminishing cross-sectional area from first or lower section 116 to second or upper section 118 as is shown in FIG. 3. Third one-piece base housing first section through passage cross-sectional area is substantially equal to first or second cross-sectional through passage areas of either first or second one-piece base housings 22 or 24.

Third one-piece base housing 112 is substantially U-shaped in cross-sectional contour and is mounted to external wall 16 of building structure 14 through housing flange members 32 and openings 34 formed therethrough for bolting, nailing, or other rigid attachment not important to the inventive concept as herein described.

Third one-piece base housing 112 as in the case of all other housing sections herein described may be molded in a one-piece formation and may be particularly formed of a closed-cell plastic composition.

Dependent upon the vertical height and other configuration criteria of building structure 14, facade system 10 may further include fourth base housing 120, fifth base housing 122, and cap member 124, as is shown in FIGS. 1–3. As has been previously described, each of fourth base housing 120, fifth base housing 122, and cap member 124 may be formed in one-piece formatic and in particular, of a closed-cell plastic compositicn.

Fourth base housing 120 may be generally U-shaped in contour and attached in fixed securement to external wall 16 of building structure 14 through housing flange members 32 which extend in a normal direction from the sidewalls of fourth base housing 120. Bolts, nails, or some like fixed coupling may be passed through openings 34 formed in flanges 32 for fixed securement mechanism. Obviously, fourth base housing 120 may be mounted to third one-piece base housing 112 by cooperation of housing flange member 70 with a lower flange member of fourth base housing 120 for passage therethrough of bolts into and through openings 126.

Fifth base housing 122 is another modular type configuration which is box-like in contour and may be secured to the upper surface of fourth base housing 120, third one-piece base housing 112, or even in some circumstances to first or second one-piece base housings 22 and 24, dependent upon the configuration of building structure 14. As can be seen, fifth base housing 122 is often not coupled to external wall 16 of building structure 14, but may extend partially above building structure 14 in vertical direction 20.

Cap member 124 is at least partially insertable into through opening 128 in fifth base housing 122. As can be seen, there is provided cap ledge 130 which is mountable on flange member 132 passing around the periphery of area of through opening 128 of fifth base housing 122. Flange member 132 secured to cap ledge 130 provides for a structurally reinforced combined structure for molded fifth base housing 122 and cap member 124. Cap member 124 may be inserted partially into through opening 128 and cap member 124 may be secured to flange 132 by adhesive bonding, bolting, or some like technique, not important to the inventive concept as herein described.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A structurally reinforced, pre-fabricated and modular chimney facade system being adapted to be fixedly secured to an external wall of a building structure, comprising:

(a) a chimney stack passing external said building structure and being enclosed by said chimney facade system;

(b) a first one-piece base housing fixedly secured to a base foundation being positionally located external and adjacent said building structure and an external surface of said external wall, said first one-piece base housing defining a first through passage having a cross-sectional area greater than a cross-sectional area of said chimney stack;

(c) at least a second one-piece base housing removably mountable and fixedly securable to said first one-piece base housing and said external wall of said building structure, said second one-piece base housing defining a second through passage having a cross-sectional area substantially equal to said cross-sectional area of said first through passage of said first one-piece base housing at an interface of said first and second one-piece base housings; and, (d) means for structurally supporting said first and second one-piece base housings to said external wall of said building structure, said structural supporting means including means for adjustably applying a force loading between said external wall of said building structure and at least one of said first and second one-piece base housings within said first or second through passage.

2. The structurally reinforced, pre-fabricated and modular chimney facade system as recited in claim 1 wherein said base foundation housing includes:

(a) a base foundation framework secured to said external wall of said building structure; and, (b) a base wall structure substantially U-shaped in contour for interfacing and being coupled to a lower portion of said first one-piece base housing and said base foundation framework.

3. The structurally reinforced, pre-fabricated and modular chimney facade system as recited in claim 1 where said first one-piece base housing is molded in one-piece formation.

4. The structurally reinforced, pre-fabricated and modular chimney facade system as recited in claim 3 where said first one-piece base housing is formed of a plastic composition.

5. The structurally reinforced, pre-fabricated and modular chimney facade system as recited in claim 1 where said second one-piece base housing is molded in one-piece formation.

6. The structurally reinforced, pre-fabricated and modular chimney facade system as recited in claim 5 where said second one-piece base housing is formed of a plastic composition.

7. The structurally reinforced, pre-fabricated and modular facade system as recited in claim 1 including a third one-piece base housing fixedly secured in aligned relation with said first or second one-piece base housings, said third one-piece base housing removably mountable and fixedly securable to said first or second one-piece base housings and said external wall of said building structure, said third one-piece base housing defining a transition through passage of diminishing cross-sectional area from a first section to a second section thereof, said third one-piece base housing first section through passage cross-sectional area being substantially equal to said first or second cross-sectional through passage area of either said first or second one-piece base housings.

8. The structurally reinforced, pre-fabricated and modular chimney facade system as recited in claim 7 where said third one-piece base housing is molded in one-piece formation.

9. The structurally reinforced, pre-fabricated and modular chimney facade system as recited in claim 8 where said third one-piece base housing is formed of a plastic composition.

10. The structurally reinforced, pre-fabricated and modular chimney facade system as recited in claim 1 where said structural support means includes:

(a) at least one rod member extending in a substantially vertical direction within a wall member of at least said first one-piece base housing and extending above an upper surface thereof for interfitting with a next vertically mounted base housing; and, (b) means for securing said rod member to said external wall of said building structure.

11. The structurally reinforced, pre-fabricated and modular chimney facade system as recited in claim 10 where each of said first and second one-piece housings include a pair of displaced sidewalls and a frontal wall coupled to said displaced sidewalls and a pair of rod members extending in a substantially vertical direction within said first and second one-piece housings at opposing intersections of said frontal and sidewalls.

12. The structurally reinforced, pre-fabricated and modular chimney facade system as recited in claim 10 where said securement means includes turnbuckle means coupled on a first end thereof to said rod member and on a second end thereof to said external wall of said building structure.

13. The structurally reinforced, pre-fabricated and modular chimney facade system as recited in claim 12 where said turnbuckle means includes at least one external wall stud member, said turnbuckle means second end being rigidly secured to said external wall stud member.

14. The structurally reinforced, pre-fabricated and modular chimney facade system as recited in claim 12 where said turnbuckle means includes a turnbuckle lug member secured to said first end of said turnbuckle means, said turnbuckle lug member having a through opening for insert of and passage therethrough of said rod member.

15. The structurally reinforced, pre-fabricated and modular chimney facade system as recited in claim 1 including means for coupling said first and second one-piece housings each to the other and in combination securement to said external wall of said building structure.

16. The structurally reinforced, pre-fabricated and modular chimney facade system as recited in claim 15 where said first and second one-piece base housings each include a frontal wall and a pair of laterally displaced sidewalls formed in one-piece formation, said first one-piece base housing having a first base housing flange member at an upper section thereof extending internal said through opening, said second one-piece base housing having a second base housing flange member at a lower section thereof extending internal said through opening for mating interface with said first base housing member, said first and second base housing flange members being captured within said coupling means.

17. The structurally reinforced, pre-fabricated and modular chimney facade system as recited in claim 16 where said first and second base housing flange members are substantially planar and extend substantially normal said frontal walls and said laterally displaced sidewalls of said first and second base housings, said first and second base housing flange members forming an internal ledge when matingly engaged.

18. The structurally reinforced, pre-fabricated and modular chimney facade system as recited in claim 17 where said coupling means includes mounting bracket means comprising:

(a) a substantially planar coupling plate member fixedly securable to said external wall of said building structure; and, (b) a U-shaped coupling plate member secured to said planar coupling plate member and extending substantially normal therefrom, said internal ledge being captured within said U-shaped coupling plate member in fixed securement thereto.

19. The structurally reinforced, pre-fabricated and modular chimney facade system as recited in claim 18 where said substantially planar coupling plate member and said U-shaped coupling plate member are formed in one-piece formation.

20. The structurally reinforced, pre-fabricated and modular chimney facade system as recited in claim 18 where said substantially planar coupling plate member is fixedly secured to a stud member fixedly mounted to said external wall of said building structure.

21. The structurally reinforced, pre-fabricated and modular chimney facade system as recited in claim 18 where said U-shaped coupling plate member is rigidly secured to said internal ledge by a bolt member passing through said U-shaped coupling plate member.

22. The structurally reinforced, pre-fabricated and modular chimney facade system as recited in claim 18 including at least one U-shaped clamp member for clampingly engaging at least a portion of said internal ledge therein.

23. The stuctucturally reinforced, pre-fabricated and modular chimney facade system as recited in claim 18 including an L-shaped reinforcement member having a U-shaped contour for insert therein of at least a portion of said internal ledge along at least a portion of at least one sidewall and said frontal wall of said first and second one-piece base housings.

24. The structurally reinforced, pre-fabricated and modular chimney facade system as recited in claim 23 where said L-shaped reinforcement member is insertable within said U-shaped coupling plate member and fixedly secured thereto.

25. A structurally reinforced, pre-fabricated and modular chimney facade system being adapted to be fixedly secured to a roof of a building structure, comprising:

(a) a chimney stack passing external said building structure and being enclosed by said chimney facade system;

(b) a one-piece base housing securable to said roof of said building, said base housing having a through passage of cross-sectional area greater than a cross-sectional area of said chimney stack; and, (c) a cap member at least partially insertable into said one-piece base housing and securable thereto, said cap member having a through passage substantially conincident with said base housing through passage.

26. The structurally reinforced, pre-fabricated and modular chimney facade system as recited in claim 25 where said one-piece base housing includes a flange member extending internal said base housing through passage for mounting said cap member thereon.

27. The structurally reinforced, pre-fabricated and modular chimney facade system as recited in claim 26 where said cap member includes a cap ledge extending around a peripheral boundary of said cap member for contiguous interface with said base housing flange member.

28. The structurally reinforced, pre-fabricated and modular chimney facade system as recited in claim 25 where said one-piece base housing is molded in one-piece formation.

29. The structurally reinforced, pre-fabricated and modular chimney facade system as recited in claim 28 where said one-piece base housing is formed of a plastic composition.

30. The structurally reinforced, pre-fabricated and modular chimney facade system as recited in claim 25 where said cap member is molded in one-piece formation.

31. The structurally reinforced, pre-fabricated and modular chimney facade system as recited in claim 30 where said cap member is formed of a plastic composition.

* * * * *